US007753710B2

(12) United States Patent
George

(10) Patent No.: US 7,753,710 B2
(45) Date of Patent: Jul. 13, 2010

(54) LATCHING SYSTEM WITH SINGLE-HANDED OPERATION FOR CONNECTOR ASSEMBLY

(75) Inventor: Joseph George, Amherst, NH (US)

(73) Assignee: Amphenol Corporation, Wallingford, CT (US)

( * ) Notice: Subject to any disclaimer, the term of this patent is extended or adjusted under 35 U.S.C. 154(b) by 7 days.

(21) Appl. No.: 12/245,382

(22) Filed: Oct. 3, 2008

(65) Prior Publication Data

US 2010/0087084 A1 Apr. 8, 2010

(51) Int. Cl.
*H01R 13/627* (2006.01)

(52) U.S. Cl. ..... 439/352

(58) Field of Classification Search ..... 439/352, 439/353–357, 483, 489
See application file for complete search history.

(56) References Cited

U.S. PATENT DOCUMENTS

| | | | | |
|---|---|---|---|---|
| 5,122,076 | A * | 6/1992 | Pitts | 439/352 |
| 6,217,372 | B1 | 4/2001 | Reed | |
| 6,380,485 | B1 | 4/2002 | Beaman et al. | |
| 6,394,839 | B2 | 5/2002 | Reed | |
| 6,398,588 | B1 | 6/2002 | Bickford | |
| 6,428,344 | B1 | 8/2002 | Reed | |
| 6,482,017 | B1 | 11/2002 | Van Doorn | |
| 6,616,482 | B2 | 9/2003 | De La Cruz et al. | |
| 6,762,941 | B2 | 7/2004 | Roth | |
| 6,776,645 | B2 | 8/2004 | Roth et al. | |
| 6,823,587 | B2 | 11/2004 | Reed | |
| 6,857,899 | B2 | 2/2005 | Reed et al. | |
| 7,074,086 | B2 | 7/2006 | Cohen et al. | |
| 7,309,250 | B2 * | 12/2007 | Reed et al. | 439/352 |
| 7,318,740 | B1 * | 1/2008 | Henry et al. | 439/352 |
| 7,322,845 | B2 * | 1/2008 | Regnier et al. | 439/352 |
| 7,473,124 | B1 * | 1/2009 | Briant et al. | 439/352 |
| 7,581,978 | B1 * | 9/2009 | Briant | 439/358 |
| 2004/0023546 | A1 * | 2/2004 | Wu | 439/352 |
| 2006/0189197 | A1 * | 8/2006 | Reed et al. | 439/352 |
| 2007/0243749 | A1 * | 10/2007 | Wu | 439/352 |

OTHER PUBLICATIONS www.gore.com, Military Fibre Channel High Speed Cable Assembly, © 2008, printed Apr. 7, 2008, pp. 1-5.
Brian Beaman, High Performance Mainframe Computer Cables, Electronic Components and Technology Conference, 1997, pp. 911-917.

* cited by examiner

*Primary Examiner*—Michael C Zarroli
*Assistant Examiner*—Harshad C Patel
(74) *Attorney, Agent, or Firm*—Blank Rome LLP

(57) ABSTRACT

A latching system is described. The latching system includes a lower latch, an upper latch slidably engaging a top surface of the lower latch, a latch release mechanism connected to the upper latch, and a lock receiving member. The lower latch has a body with the top surface, a head formed at one end of the body, and a pivot formed at an opposite end of the body. The head includes a leading edge and a latching portion. The upper latch has a wedge portion. The receiving lock member has a lower arm with an upturned lip at a leading end formed to engage the leading edge of the lower latch, an inside face continuously formed with the leading end and a bottom formed on an inner part of the upturned lip, and an upper arm that engages the wedge portion of the upper latch.

26 Claims, 13 Drawing Sheets

LATCHING SYSTEM WITH SINGLE-HANDED OPERATION FOR CONNECTOR ASSEMBLY

FIELD OF THE INVENTION

The present invention relates to a latching system. In particular, the present invention relates to a latching system for a connector assembly that can be coupled and decoupled single-handedly.

BACKGROUND OF THE INVENTION

Latching systems for connector assemblies have long been known in the art. For example, U.S. Pat. No. 6,776,645 to Roth et al., patented Aug. 17, 2004, entitled "Latch and Release System for a Connector," filed on Dec. 20, 2002, describes a latch and release system. However, there is a need in the art for latching systems that can be operated single-handedly. Also, there is a need for a latching system that is compact enough to be employed where several connectors are disposed immediately adjacent to each other. Furthermore, there is a need for a latching system that can also be operated by a small tool instead of an operator's hand when several adjacent connectors are too close to each other to allow an operator's hand to disconnect the connectors.

SUMMARY OF THE INVENTION

Accordingly, an aspect of the invention provides a latching system. Another aspect of the invention provides a connector assembly. It is an object of the invention to provide a latching system that is operated single-handedly. It is another object of the invention to provide a lockable latch. It is yet another object of the invention to provide a latching system that allows compact connector assemblies to be placed immediately adjacent to each other.

One embodiment of the invention provides a latching system. The latching system includes a lower latch, an upper latch slidably engaging a top surface of the lower latch, a latch release mechanism connected to the upper latch, and a lock receiving member. The lower latch has a body with the top surface, a head formed at one end of the body, and a pivot formed at an opposite end of the body. The head includes a leading edge and a latching portion. The upper latch has a wedge portion. The receiving lock member has a lower arm with an upturned lip at a leading end formed to engage the leading edge of the lower latch, an inside face continuously formed with the leading end and a bottom formed on an inner part of the upturned lip, and an upper arm that engages the wedge portion of the upper latch.

Another embodiment of the invention provides a latching system. The latching system includes lower latches, upper latches, a latch release mechanism connected to the upper latches, and receiving lock members. Each of the lower latches has a body with a top surface, a head formed at one end of the body, and pivots formed at an opposite end of the body. Each of the heads includes a leading edge and a latching portion. Each of the upper latches has a wedge portion. Each of the receiving lock member has a lower arm with an upturned lip at a leading end formed to engage the leading edge of the lower latch, an inside face continuously formed with the leading end and a bottom formed on an inner part of the upturned lip, and an upper arm that engages the wedge portion of the upper latch.

Other objects, advantages and salient features of the invention will become apparent from the following detailed description, which, taken in conjunction with the annexed drawings, discloses an exemplary embodiment of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-13, the invention provides a latching system that can be used with a connector assembly 10. The latching system provides single-handed operation to couple and decouple the connector assembly 10. The latching system includes a lockable latch. The latching system can have a compact construction that allows multiple connector assemblies 10 to be grouped densely together.

Figure 1:
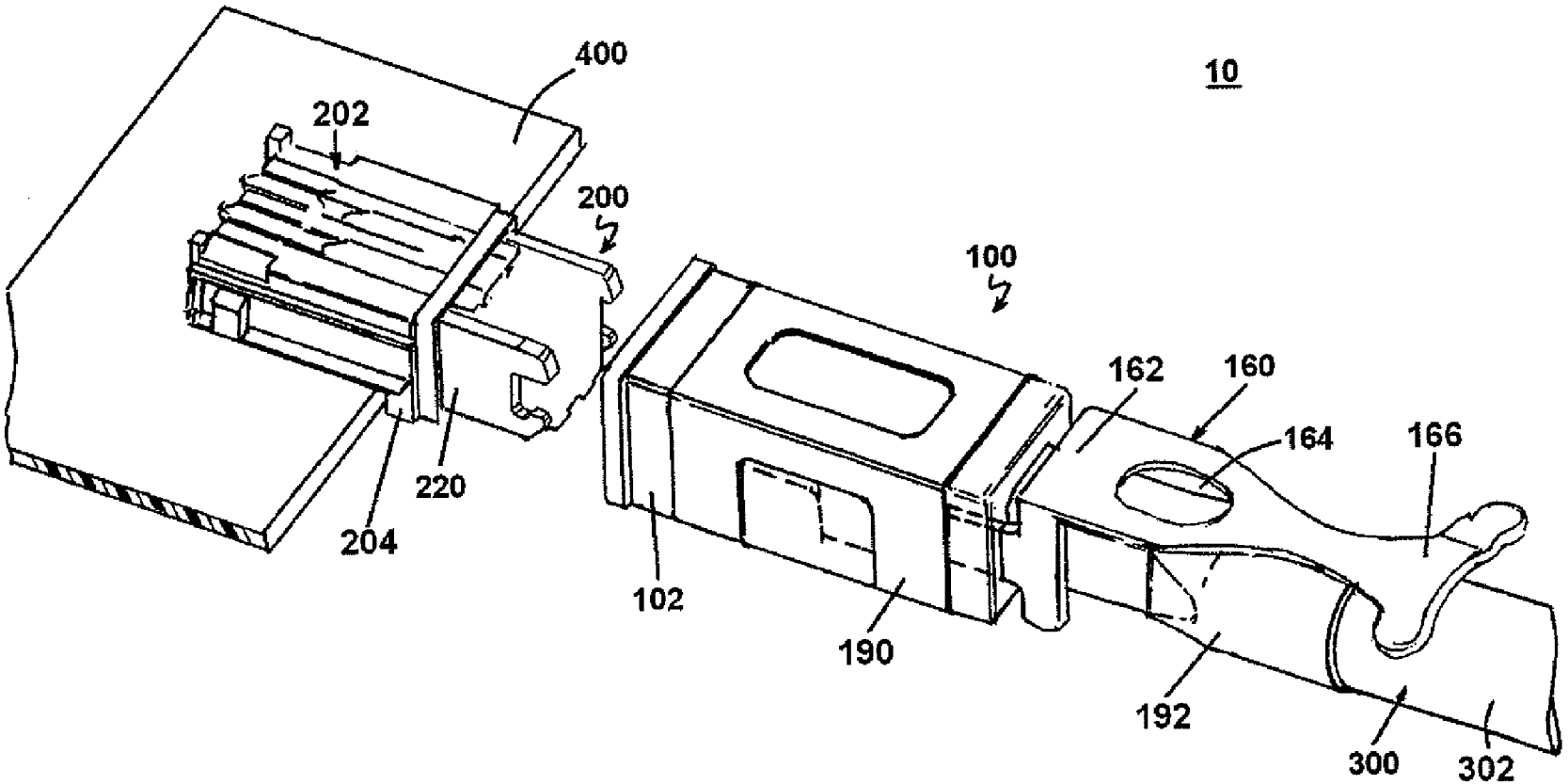
FIG. 1 is a perspective view of a connector assembly according to an exemplary embodiment of the invention.

Referring to FIG. 1, the connector assembly 10 is shown. The connector assembly includes, at least, a connector plug 100 and a mating connector 200. At least, one lower latch 120 (shown in FIG. 2) and one upper latch 140 (shown in FIG. 5) is disposed in either the connector plug 100 or the mating connector 200. The terms "upper," "lower," "front," "rear," "forward," "rearward," "side," "top," "bottom," and the like are used herein describe the relative positions of described components and are not meant to be limiting to the invention. At least one receiving lock member 220 is disposed in the opposite mating receptacle 200 or connector plug 100, and the receiving lock member 220 receives the lower latch 120 to couple the connector plug 100 with the mating connector 200. After receiving the lower latch 120, the receiving lock member 220 also receives the upper latch 140 to prevent the lower latch 120 from disengaging from the receiving lock member 220. Thus, the receiving lock member 220 receives the upper and lower latches 120 and 140 to lock or latch the connector plug 100 to the mating connector 200, and therefore, the lower latch 120, the upper latch 140, and the lock receiving member 220 provide a lockable latch.

To decouple the connector plug 100 and the mating connector 200, a user operates a latch release mechanism 160. At least the upper latch 120 or the lower latch 140 is coupled to the latch release mechanism 160 so that the latch release mechanism 160 can release the upper and lower latches 120 and 140 from the receiving lock member 220, and thus, the connector plug 100 and the mating connector 200 can be separated. In the embodiment shown, the latch release mechanism 160 is coupled to the upper latch 140. The latch release mechanism 160 can be operated single-handedly or by a tool. For single-handed operation, pulling a handle portion 162 of the latch release mechanism 160 away from the receiving lock member 220 disengages the upper latch 140 from the receiving lock member 220, which allows the lower latch 120 to also disengage from the receiving lock member 220. A hole 164 is disposed on the latch release mechanism 160. When the handle portion 162 is not readily accessible, a tool can be used to engage the hole 164 and pull the latch release mechanism 160 away from the lock receiving member 220 and thus release the upper latch 140 and the lower latch 120 from the receiving lock member 220. Thus, the lower latch 120, the upper latch 140, the latch release mechanism 160, and the lock receiving member 220 provide a releasable lockable latch that can be operated single-handedly or by a tool.

Also, the lower latch 120, the upper latch 140, the latch release mechanism 160, and the lock receiving member 220 have planar forms so that they are compact and can be disposed to the side(s) of the connector plug 100 or the mating connector 200. In alternate embodiments, the lower latch 120, the upper latch 140, the latch release mechanism 160, and the lock receiving member 220 can be disposed within the connector plug 100 or the mating connector 200 instead of to one side. Thus, the lower latch 120, the upper latch 140, the latch release mechanism 160, and the lock receiving member 220 have a compact construction that allows multiple connector assemblies 10 to be grouped densely together.

In FIG. 1, the connector plug 100 and the mating connector 200 are shown aligned prior to being latchably coupled to each other. The connector plug 100 terminates a cable braid 300, and the mating connector 200 is coupled to a circuit board 400. The connector plug 100 mechanically and electrically couples to the mating connector 200 to provide an electrical pathway between the cable braid 300 and the circuit board 400.

The cable braid 300 is received through a braid retention device 192. The braid retention device 192 controls the bend of the cable braid 300 where it meets the connector plug 100. By controlling the bend of the cable braid 300, the braid retention device 192 minimizes stress to the vulnerable point where the cable braid 300 meets the connector plug 100. The braid retention device 192 is made of die cast metal or other suitably rigid material. The cable braid 300 has a plastic jacket 302 that contains the multiple cables, but the plastic jacket 302 does not extend into the braid retention device 192. The end of the braid retention device 192 is crimped to the cable braid 300 so that the cable braid 300 does not separate from the braid retention device 192. The other end of the braid retention device 192 is fixed to the housing 102 so that the braid retention device 192 does not come free and the cable braid 300 is fixed to the housing 102 of the connector plug 100.

In the embodiment shown, for ease of manufacturing, the housing 102 of the connector plug 100 is manufactured in two parts, an upper portion (shown in FIG. 4) and a lower portion (shown in FIG. 2), which are mechanically coupled to each other by a spring clip 190. The spring clip 190 at least partially wraps around an outermost perimeter of the housing 102 and sits within a recess on the outside of the housing 102. The housing 102 is made of die cast metal, but any suitably rigid material can be used for the housing 102. The spring clip 190 is made of from metal, such as steel or aluminum, shaped through a stamping process or a progressive stamping process.

Figure 2:
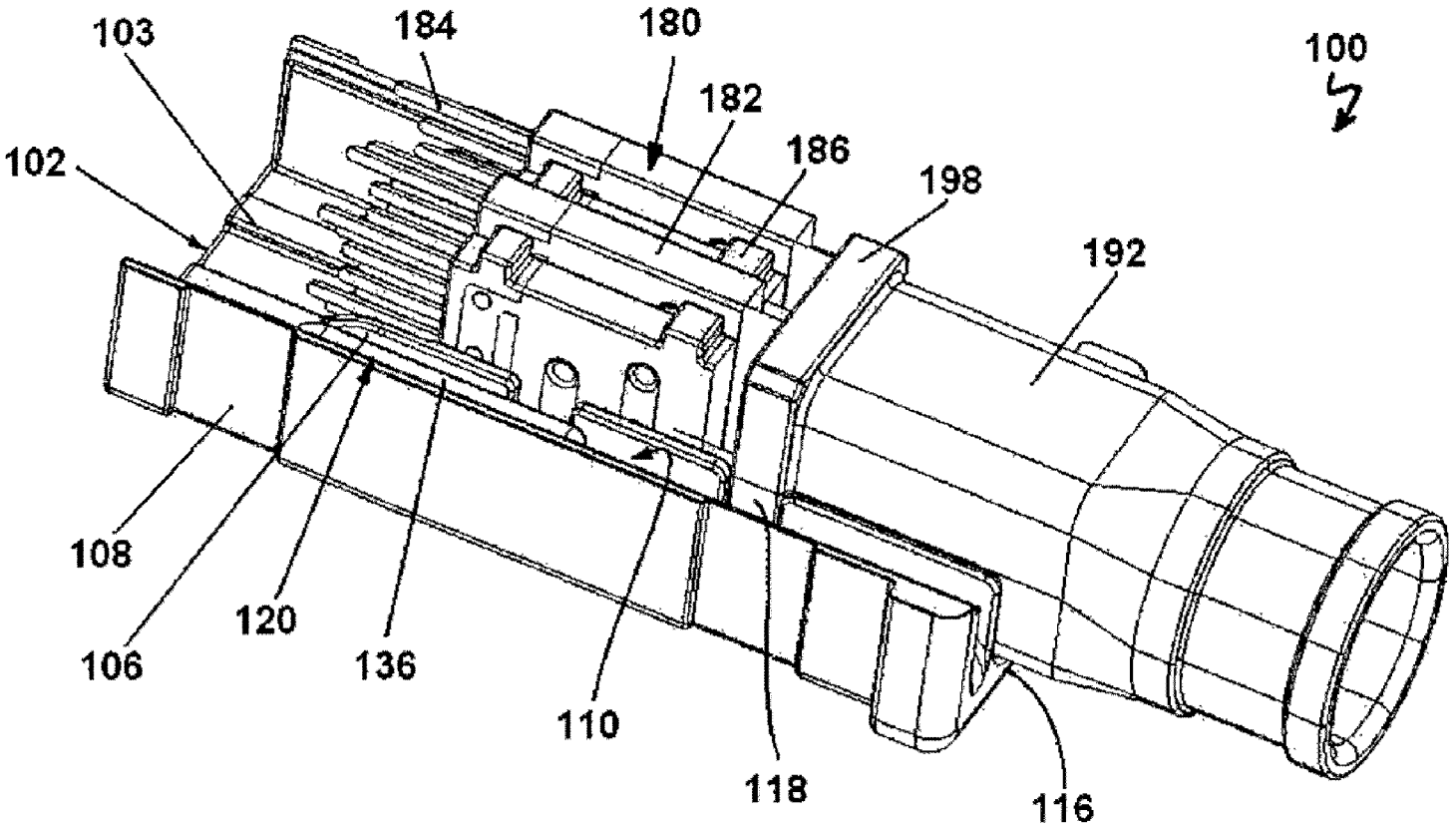
FIG. 2 is a perspective view of a connector plug of the connector assembly illustrated in FIG. 1, with a portion of a housing, a spring clip, and a latch release member of the connector plug omitted for clarity.

Referring to FIG. 2, the connector plug 100 is shown with the lower portion of the housing 102. The upper portion of the housing 102, the spring clip 190, and the latch release mechanism 160 are not depicted so as to illustrate the internal components of the connector plug 100. In the embodiment shown, the connector plug 100 has within the housing 102: electrical connector wafers 180, at least a part of the braid retention device 192, the lower latches 120, the upper latches 140 (shown in FIG. 5), and at least a part of the latch release mechanism 160 (shown in FIG. 1).

The cable braid 300 (shown in FIG. 1) is received through the braid retention device 192 and terminates in the wafers 180. The cable braid 300 is made up of multiple cables. The cables of the cable braid 300 split off inside the braid retention device 192, and each cable separately connects to a respective wafer 180. The wafers 180 provide shielded, electrical pathways between the mating connector 200 (shown in FIG. 1) and the cable braid 300 (shown in FIG. 1). Each wafer 180 has a wafer housing 182, at least one lead 184 extending from the wafer housing 182, and at least one projection or tab 186 extending from the wafer housing 182. In the embodiment shown, the wafer housings 182 have a planar, rectangular form that allows the wafers 180 to be aligned side by side in the housing 102 of the connector plug 100. The leads 184 extend from a front edge of the wafer housing 182 and connect with leads 290 (shown in FIG. 9) in the mating connector 200. The projections or tabs 186 extend from the wafer housing 182 and allow the wafer 180 to be inserted in the connector plug 100 in the proper orientation. The projections or tabs 186 engage corresponding mating slots 105 (shown in FIG. 4) in the housing 102 to prevent the wafer 180 from moving forward or backward relative to the connector plug 100 and ensure that the wafer 180 is aligned in the proper orientation. A ground sleeve (not shown) is positioned within the wafer housing 182 along one side to shield against crosstalk between wafers 180. The wafer 180 is described in more detail in co-pending application entitled "Ground Sleeve Having Improved Impedance Control and High Frequency Performance" by Atkinson, et al., Ser. No. 12/240,577, Publication No. 2010/0081302, filed Sep. 29, 2008, the entire disclosure of which is incorporated herein by reference.

Figure 3:
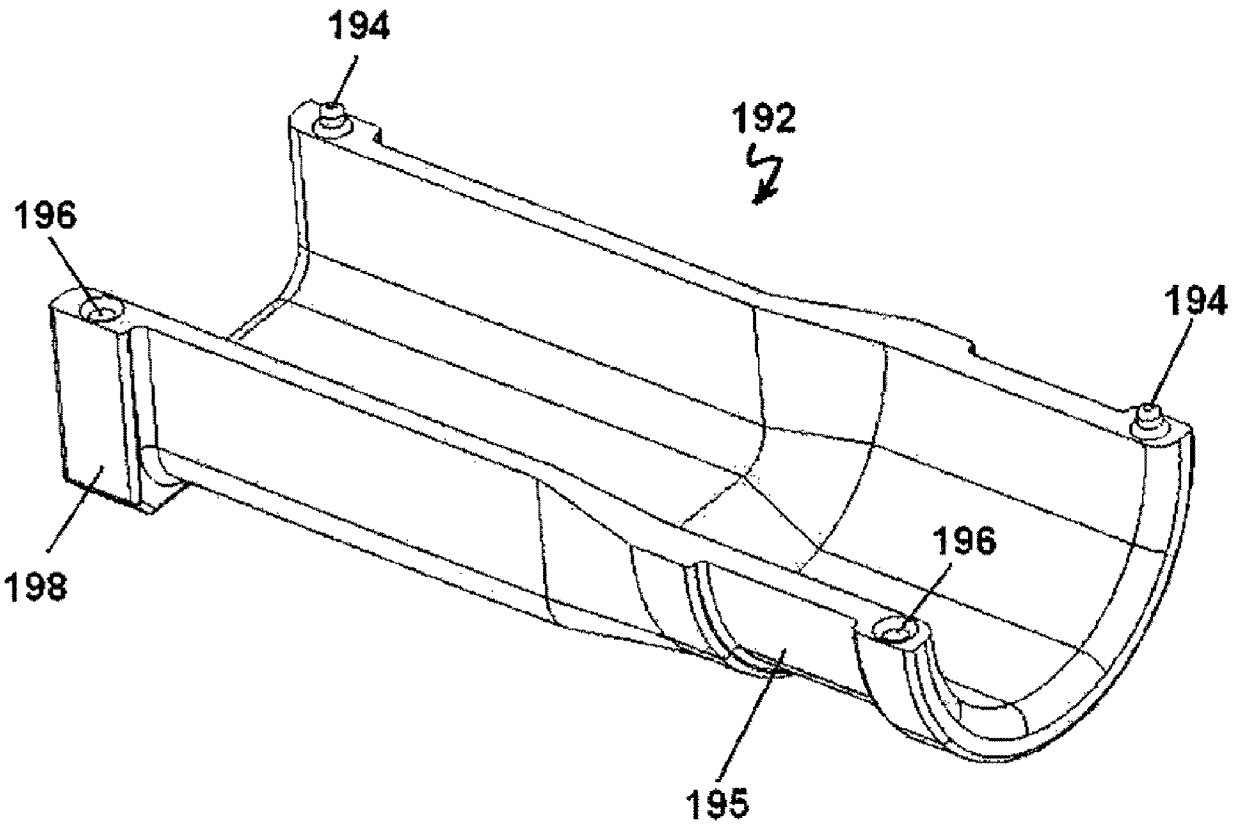
FIG. 3 is a perspective view of a portion of a braid retention device illustrated in FIG. 1.

Referring to FIG. 3, a lower portion of the braid retention device 192 is shown. In the embodiment shown, the braid retention device 192 is made in two parts. The braid retention device 192 has a widened rectangular ledge 198 formed about the front periphery of the braid retention device 192. The widened rectangular ledge 198 couples with a slot 118 (shown in FIG. 4) in the housing 102 to prevent the braid retention device 192 from pulling free of the housing 102. Each portion of the braid retention device 192 can also have pins 194 and receiving holes 196. The pins 194 and receiving holes 196 ensure that the mating portions of the braid retention device 192 are properly connected and will not slide past each other. The braid retention device 192 can also have a recess 195 disposed on the braid retention device 192. The recess 195 receives a retaining device (not shown), such as a clip or ring, to couple the upper and lower portions of the braid retention device 192.

Figure 4:
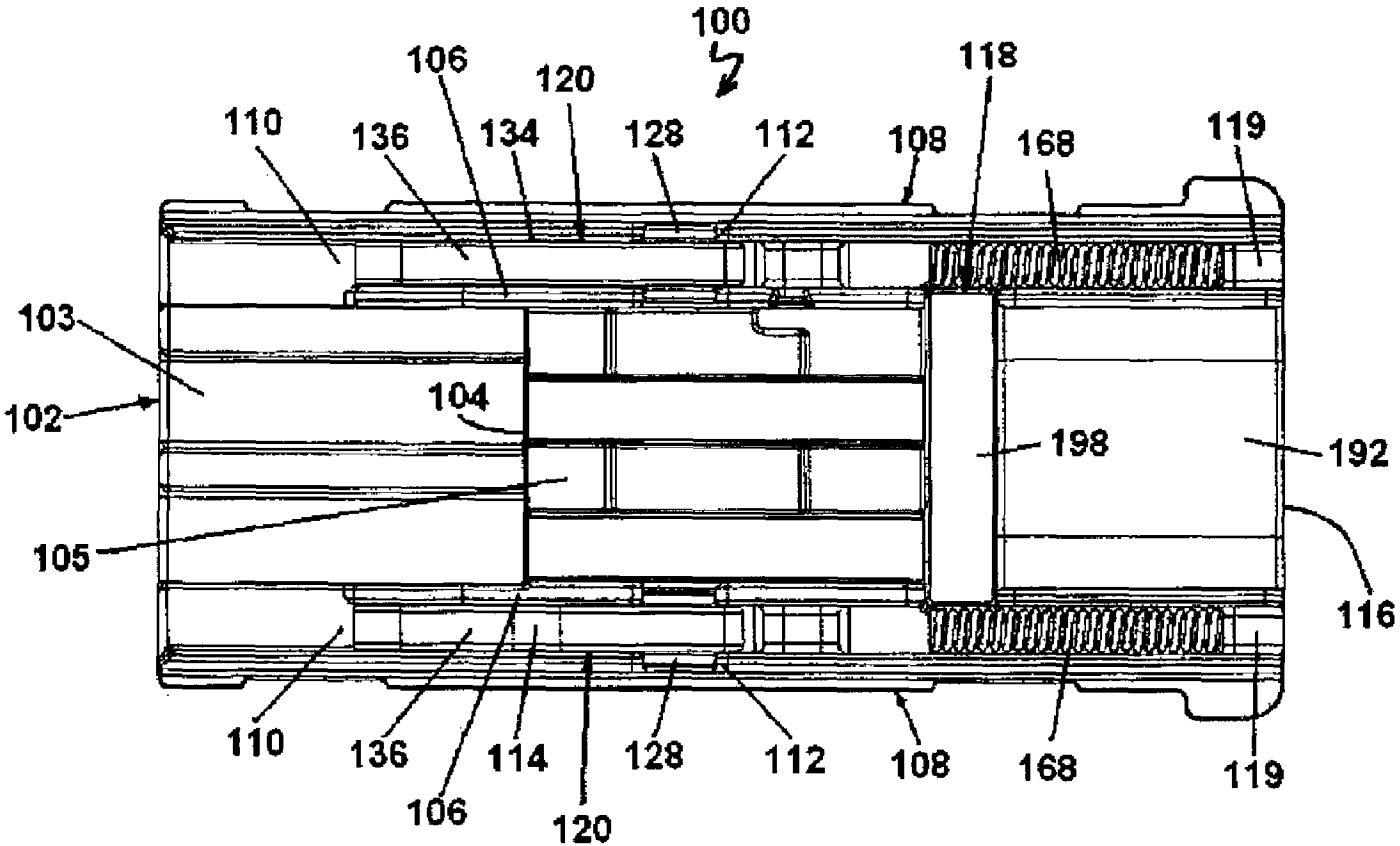
FIG. 4 is a plan view of the connector plug illustrated in FIG. 2, with a portion of the housing, wafers, and the latch release member omitted for clarity.

Referring to FIG. 4, the connector plug 100 is shown in plan view without the upper portion of the housing 102, the wafers 180, the upper latches 140, and the latch release mechanism 160. The housing 102 generally has a central receiving section 104, where the wafers 180 are received by the housing 102. The central receiving section 104 has one or more mating slots 105 to receive corresponding projections or tabs 186 extending from the wafer housings 182. In the embodiment shown, the mating slots 105 have a generally rectangular shape. In front of the central receiving section 104, the housing 102 has one or more keys 103. The one or more keys 103 engage corresponding valleys and ridges 283 (shown in FIG. 8) in the front casing 284 of the mating connector 200. The keys 103 provide alignment so that the connector plug 100 engages properly with the mating connector 200. Thus, the leads 184 (shown in FIG. 2) of the wafers 180 in the connector plug 100 avoid stubbing when engaging with the leads 290 (shown in FIG. 9) of the wafers 288 in the mating connector 200.

As further shown in FIG. 4, divider panels 106 are provided parallel to and slightly separated from each of the side walls 108 of the housing 102. The divider panels 106 and the side walls 108 of the housing 102 define side channels 110 therebetween. The side channels 110 are sufficiently wide to receive the lower latches 120 and permit the lower latches 120 to pivot freely within the side channels 110. The divider panels 106 also set the lower latches 120 apart from the wafers 180 so that the wafers 180 do not become damaged and do not interfere with the operation of the lower latches 120.

A pivot support 112 is formed as a rounded notch in each of the divider panels 106 and the side wall 108 of the housing 102. The pivot supports 112 receive pivot protrusions 128 of the lower latches 120 and allow the lower latches 120 to pivot about the pivot support 112. A support member 114 (shown in phantom) is formed to extend up from the floor of the housing 102 within each side channel 110. The lower latches 120 rest on the support members 114 when the lower latches 120 are in their lowest position (shown in FIG. 5). The support members 114 maintain the lower latches 120 at a proper height to be aligned with the receiving lock members 220 of the receptacle 200. Also, springs 168 are disposed between spring supporting portions 170 (shown in FIG. 5) of the latch release mechanism 160 and stop members 119 disposed at the rear of the channels 110 of the housing 102.

As best shown in FIG. 2, the rear 116 of the housing 102 has a rounded opening which receives the braid retention device 192. A slot 118 is provided in the top, bottom and side walls 108 of the inside of the housing 102, set back from the rear edge of the housing 102. The slot 118 receives the widened rectangular ledge 198 of the retention device 192. The rectangular ledge 198 of the braid retention device 192 engages the slot 118 to lock the braid retention device 192 within the housing 102 and prevent the braid retention device 192 from pulling free of the housing 102 when the upper and lower portions of the housing 102 are retained by the spring clip 190.

Figure 5:
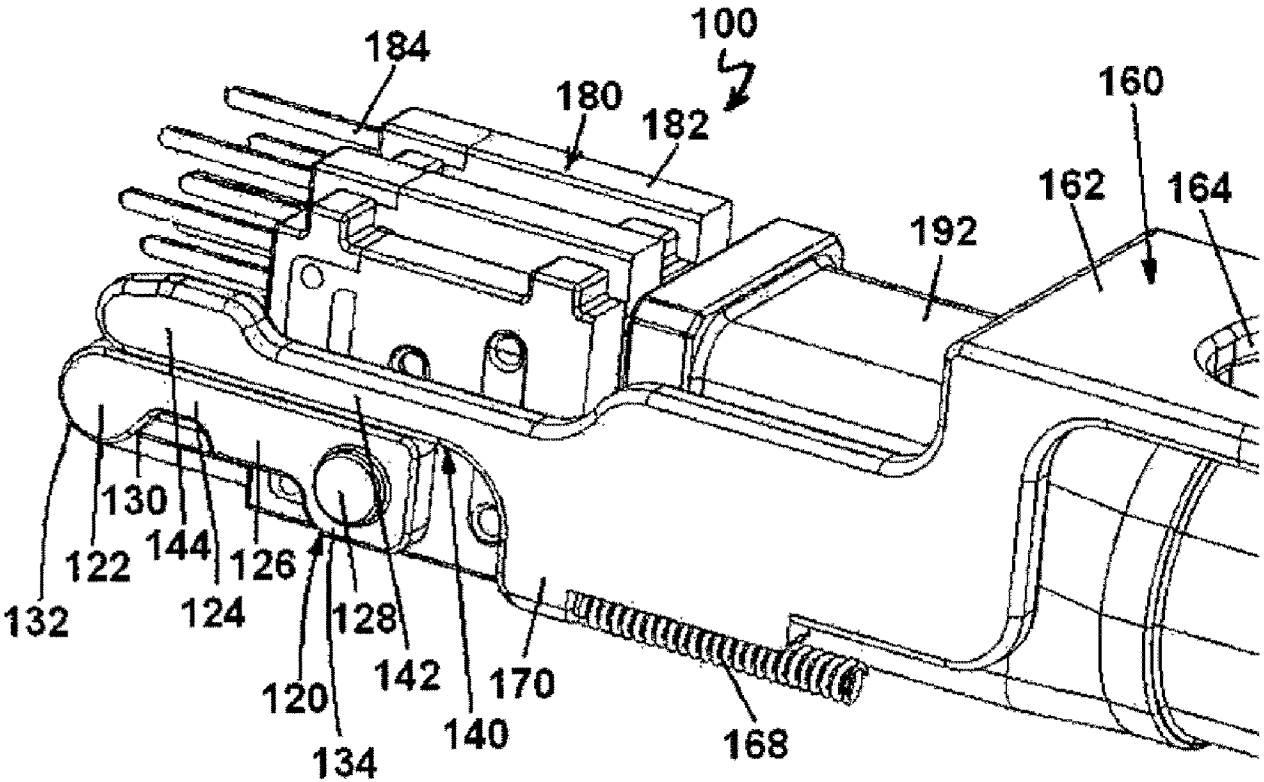
FIG. 5 is a partial perspective view of the connector plug illustrated in FIG. 1, with the housing omitted for clarity.

Referring to FIG. 5, the connector 100 is shown without the housing 102. In the embodiment shown, the connector plug 100 has two sets of upper and lower latches 120 and 140, and each set is disposed in one of the side channels 110 (shown in FIG. 4). Two sets of upper and lower latches 120 and 140 provided to add stability and strength to the connection. The two sets of upper and lower latches 120 and 140 also ensure that the connector plug 100 is fully seated with and uniformly received by the mating connector 200. Each of the lower latches 120 includes a head 122, a neck 124 adjacent to the head 122, a body or torso 126 with side surfaces 134 adjacent the neck 124 opposite the head 122, and pivots 128 disposed on the side surfaces 134. The head 122 is at one end of the lower latch 120, and the pivots 128 are at an opposite end of the lower latch 129. The head 122 has a latching portion 130 and a leading edge 132. The leading edge 132 is just below and at the front tip of the head 122. The leading edge 132 causes the lower latch 120 to pivot upward about the pivots 128. The pivots 128 are formed as rounded protrusions that extend out of the side surfaces 134 of the body 126. The pivots 128 engage the pivot supports 112 or notches (shown in FIG. 4) in the side channels 110. The lower latch 120 also has a top surface 136 that slidably engages with the upper latch 140.

Figure 13:
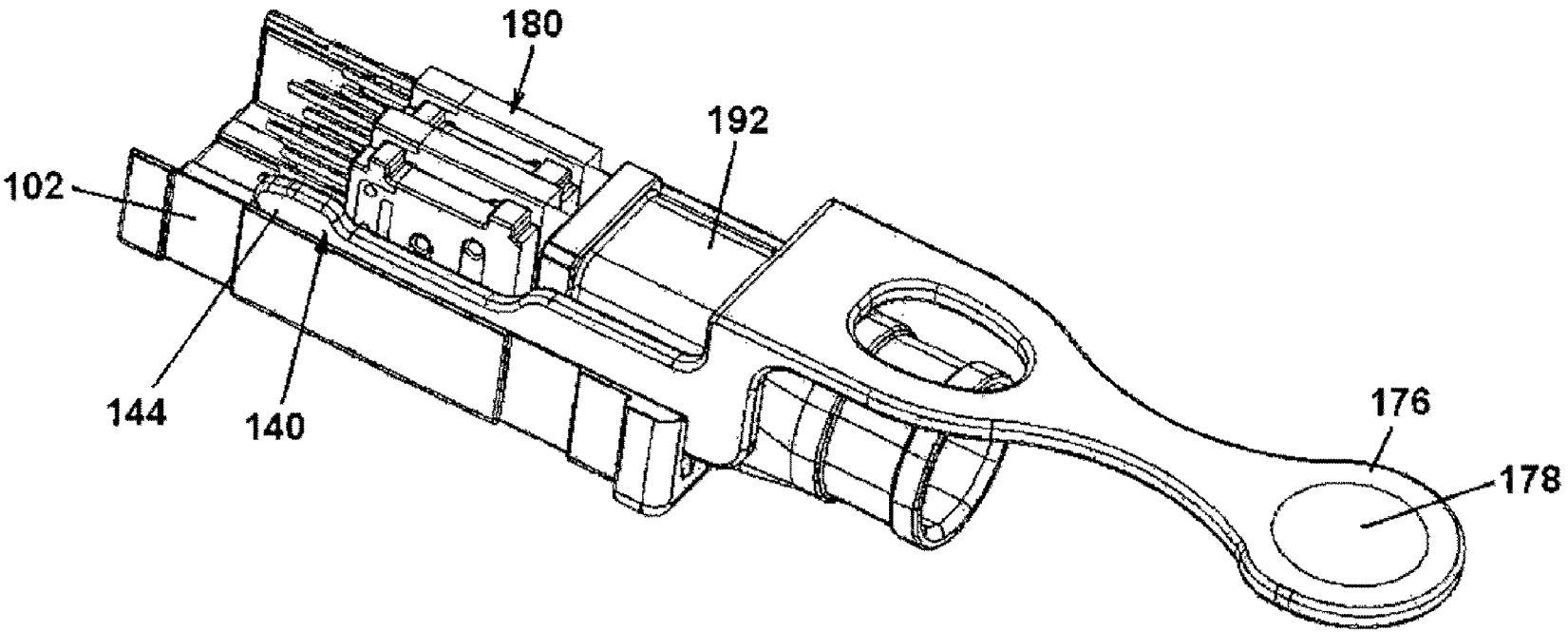
FIG. 13 is a perspective view of the connector plug according to another embodiment of the invention.

In the embodiment shown, the upper latch 140 and the release mechanism 160 are formed as a single-piece member. The upper latch 140 generally has an elongated arm 142 with a wedge portion 144 at the front end of the arm 142. The rear end of the arm 142 is connected with the release mechanism 160. The wedge portion 144 is wider than the arm 142 and wedges up against an upper arm 222 (shown in FIG. 6) of the receiving lock member 220 when the wedge portion 144 is received by the receiving lock member 220. The wedge portion 144 is also rounded to provide smooth operation and prevent stubbing. As best shown in FIG. 13, the arm 142 is at least partially received in the side channels 110 of the lower portion of the housing 102. The top portion of the arm 142 is received in a side channel 110 in the upper portion of the housing 102. The side channels 110 of the lower and upper housings 102 permit the upper latch 140 to slide freely and maintain the upper latch 140 in relation to the lower latch 120. At the same time, the side channels 110 prevent the upper latch 140 from coming into contact with the wafers 180. Because the rear end of the arm 142 is connected with the release mechanism 160, the user can release the locking engagement of the upper and lower latches 120 and 140 by pulling on the release mechanism 160 to withdraw the upper latch 140 from the receiving lock member 220.

The latch release mechanism 160 includes the cross-support 162, the hole 164, the handle portion 166, springs 168, and spring supporting portions 170. The cross-support 162 connects to the two arms 142 in the sides channels 110 of the housing 102 so that the two arms 142 operate simultaneously. The springs 168 are disposed between the spring supporting portions 170 and stop members 119 (shown in FIG. 4) disposed at the rear of the channels 110 of the housing 102.

Figure 6:
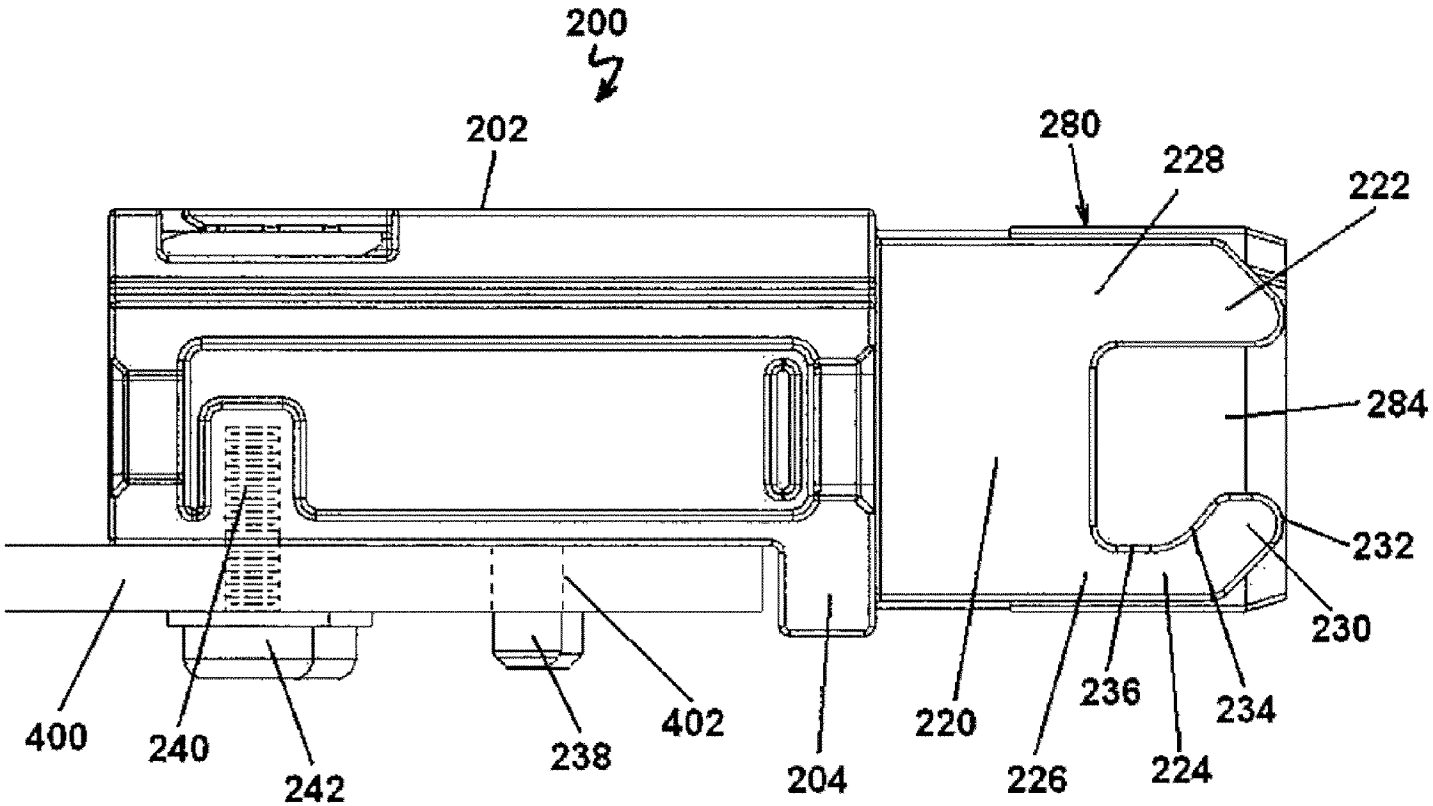
FIG. 6 is a side elevational view of a mating connector of the connector assembly illustrated in FIG. 1.

Referring to FIG. 6, the mating connector 200 is shown coupled to the circuit board 400. In the embodiment shown, the mating connector 200 has two receiving lock members 220 on opposite sides. Preferably, the number of receiving lock members 220 corresponds to the number of sets of upper and lower latches 120 and 140. Each receiving lock member 220 has an upper arm 222 and a lower arm 224. The lower arm 224 extends from a bottom end 226 of the receiving lock member 220, and the upper arm 222 extends from a top end 228 of the receiving lock member 220 to form a general C-shape. The lower arm 224 has an upturned leading lip 230 which has a leading edge 232, a sloped inside face 234, and a bottom 236. The latching portion 130 of the lower latch 120 engages with the inside face 234 of the receiving lock member 220 to latchably couple the connector plug 100 to the mating connector 200.

The receiving lock member 220 also includes a stub 238 that is received by a hole 402 in the circuit board 400. In the embodiment shown, two stubs 238 are used to add stability. The receiving lock members 220 have threaded openings 240 to further secure the receiving lock members 220 to the circuit board 400 by using screws 242. The receiving lock members 220 also mate with an electrical connector 280 that includes one or more wafers 288 (shown in FIG. 8). A mating connector housing 202 is placed substantially around the rear portion of the lock receiving members 220 and the electrical connector 280. A lip 204 is formed on the housing 202 and engages the leading edge of the circuit board 400 to further prevent the mating connector 200 from slipping back on the circuit board 400.

Figure 7:
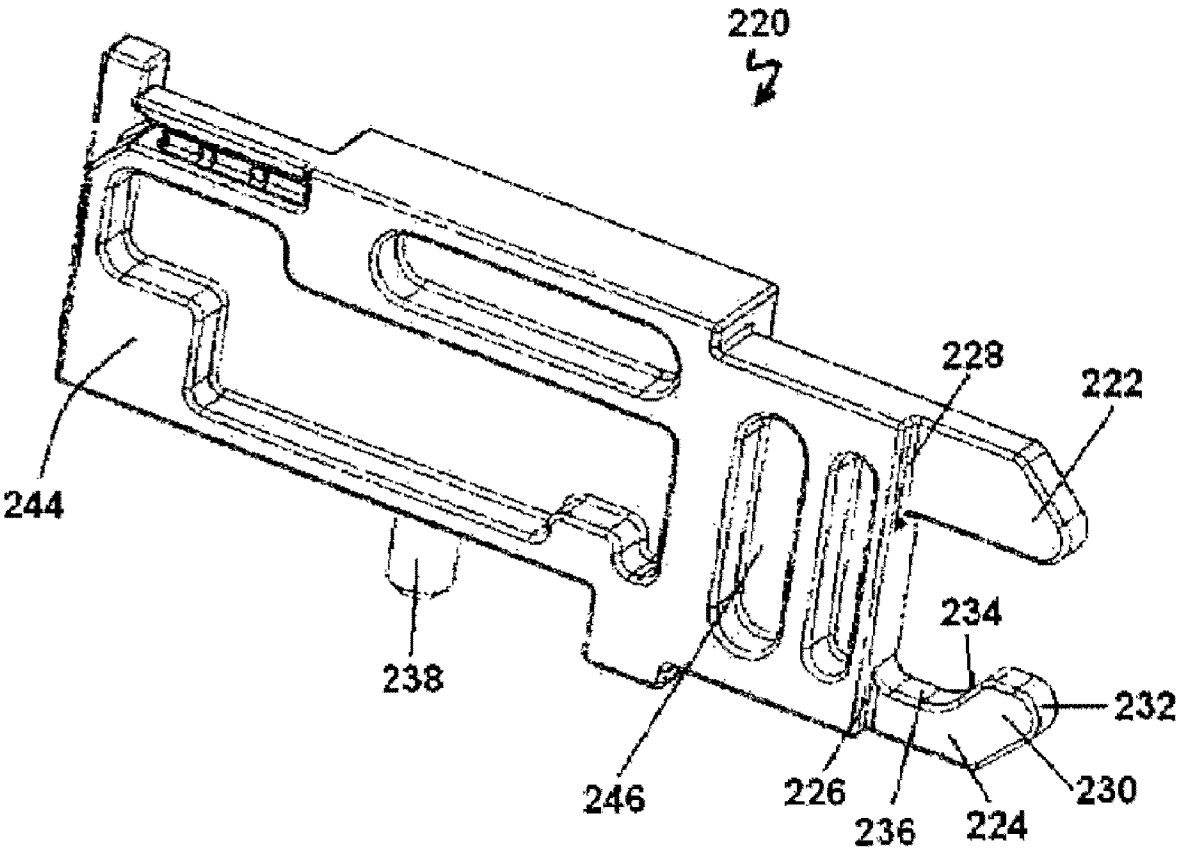
FIG. 7 is a perspective view of a receiving lock member of the mating connector illustrated in FIG. 6.
Figure 8:
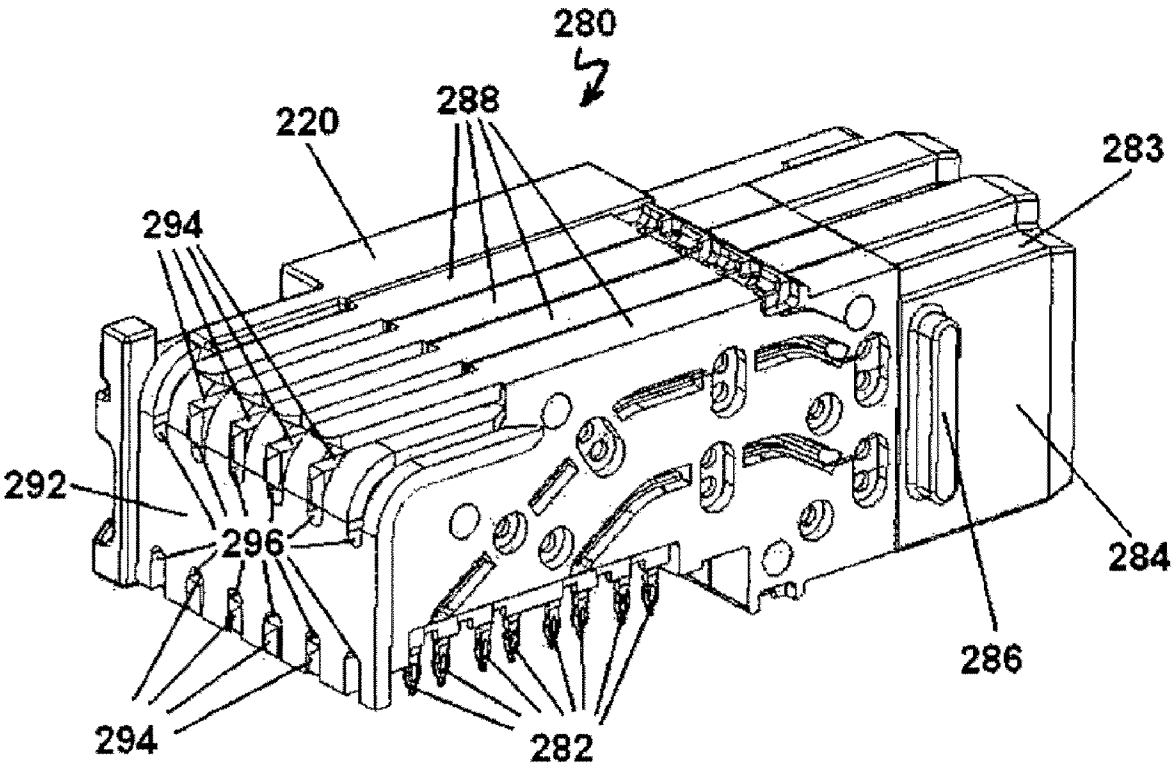
FIG. 8 is a perspective view of an electrical connector of the mating connector illustrated in FIG. 6, with a housing of the mating connector and one of the lock receiving member omitted for clarity.

Referring to FIG. 7, the mating side 244 of the receiving lock member 220 is shown. The receiving lock members 220 mate to an electrical connector 280 (shown in FIG. 6). As shown in FIG. 8, the electrical connector 208 includes one or more wafers 288. The mating side 244 of the receiving lock member 220 has one or more recesses 246 that receive one or more tabs 286 projecting from the protective front casing 284 of the electrical connector 280.

Referring to FIG. 8, the electrical connector 280 is shown without one of the receiving lock members 220. The electrical connector 280 includes one or more wafers 288 between the receiving lock members 220. Each wafer 288 of the electrical connector 280 has first contact tails 282. The first contact tails 282 provide mechanical and electrical coupling between the wafer 288 and contacts on the circuit board 400 (shown in FIG. 1). The wafers 288 also have one or more inserts 294 which are inserted into corresponding apertures 296 in a stiffener 292 to locate each wafer 288 with respect to one another and to prevent rotation of the wafers 288.

The electrical connector 280 has a front casing 284 for interfacing with the wafers 180 of the connector plug 100. The front casing 284 contains and protects the leads 290 (shown in FIG. 9) of the wafers 288. The front casing 284 has a tapered front for engaging the connector plug 100. Also, the front casing 284 aids in aligning the mating connector 200 with the connector plug 100. On one or more surfaces, the front casing 284 has valleys and ridges 283. The valleys and ridges 283 engage corresponding keys 103 in the housing 102 of the connector plug 100. The engagement of the valleys and ridges 283 with their corresponding keys 103 ensures that the connector plug 100 is properly aligned for engagement with the mating connector 200 so that the leads 184 (shown in FIG. 2) of the wafers 180 in the connector plug 100 avoid stubbing when engaging with the leads 290 (shown in FIG. 9) of the wafers 288 in the mating connector 200. The front casing 284 also has one or more tabs 286 that project out from surfaces of the front casing 284. The tabs 286 engage adjacent receiving lock members 220. Thus, by engaging the tabs 286 with the recesses 246 of the receiving lock members 220 and coupling the receiving lock members 200 to the circuit board 400, the wafers 288 are secured to the circuit board 400.

Figure 9:
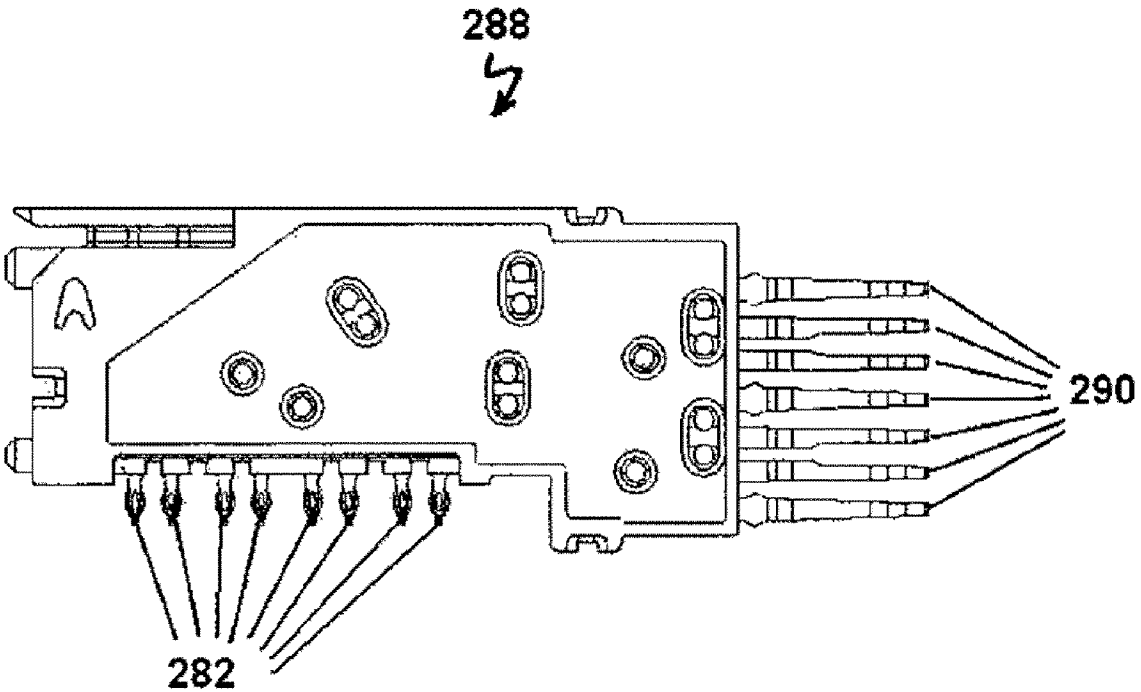
FIG. 9 is a side elevational view of a wafer of the electrical connector illustrated in FIG. 8.

Referring to FIG. 9, one of the wafers 288 is shown. The wafers 288 provide shielded electrical pathways between the circuit board 400 and the wafers 180 of the connector plug 100. The wafers 288 have contact tails 282 that electrically and mechanically couple with the circuit board 400 and contact leads 290 that electrically and mechanically couple with the leads 184 of the wafers 180 of the connector plug 100. Suitable wafers 288 for use in electrical connector 280 are shown, for instance, in U.S. Pat. No. 6,872,085 to Cohen et al., entitled "High Speed, High Density Electrical Connector Assembly."

Figure 10:
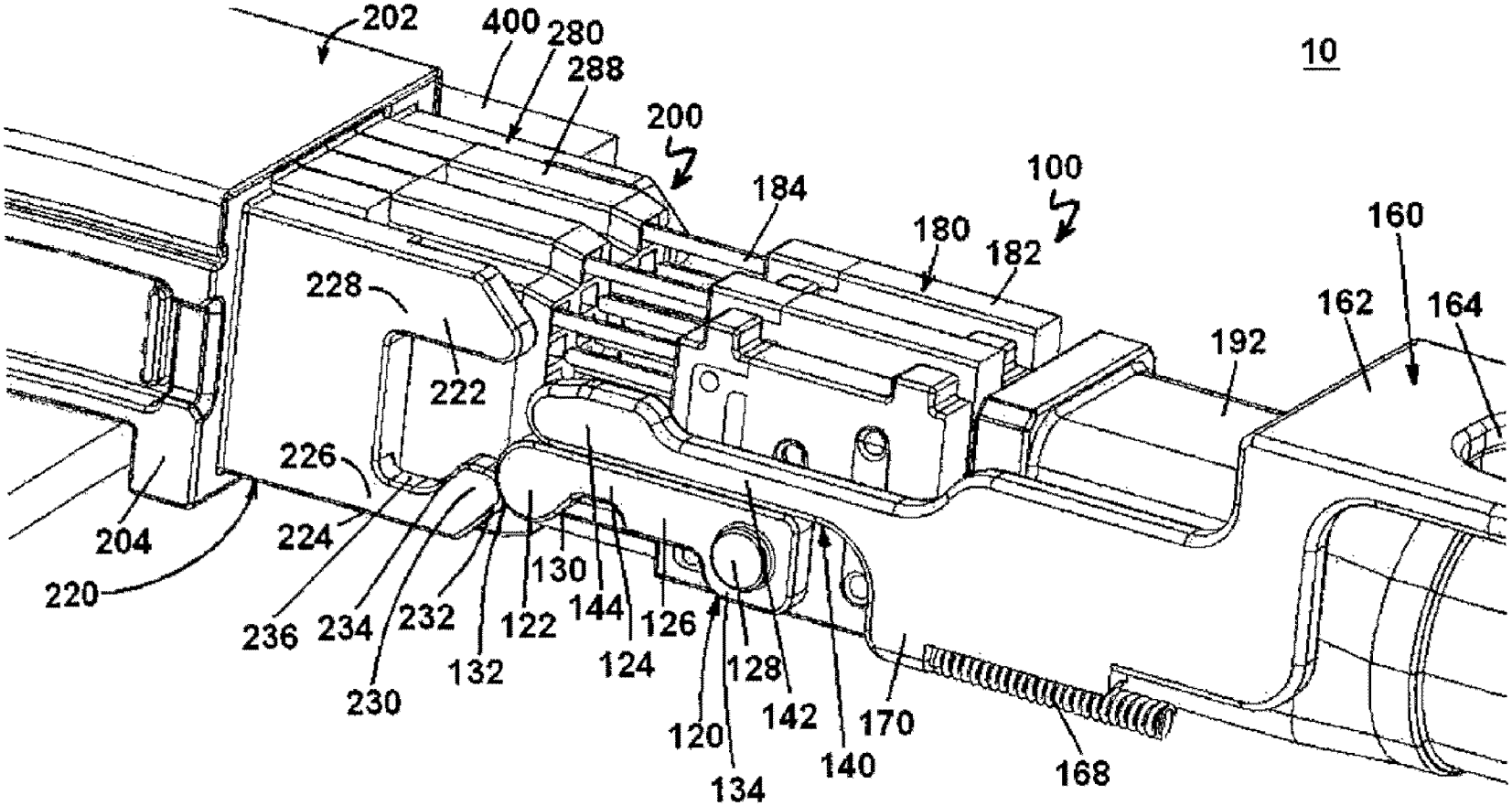
FIG. 10 is a partial perspective view of the connector plug and the mating connector of the connector assembly illustrated in FIG. 1, with a housing of the connector plug omitted for clarity.
Figure 11:
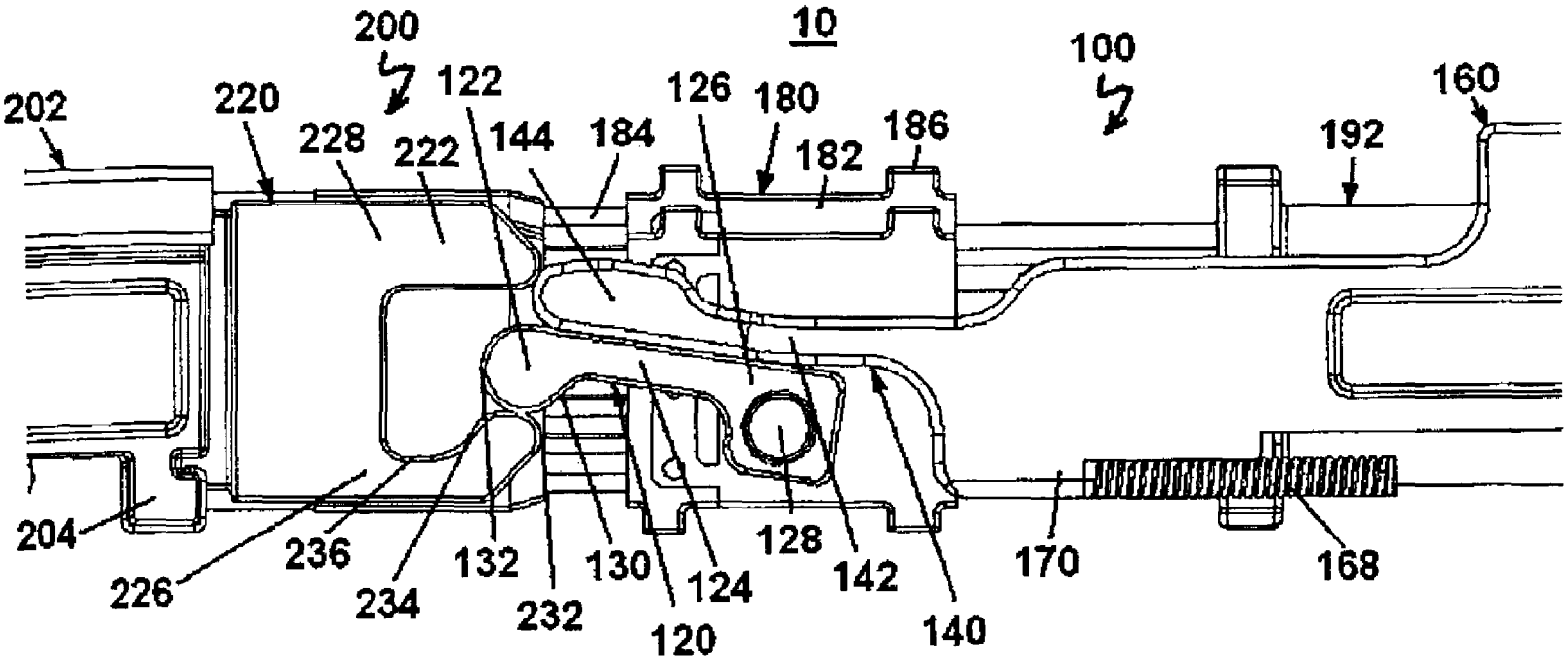
FIG. 11 is a partial side elevational view of the connector plug and the mating connector illustrated in FIG. 10, with a housing of the connector plug omitted for clarity.
Figure 12:
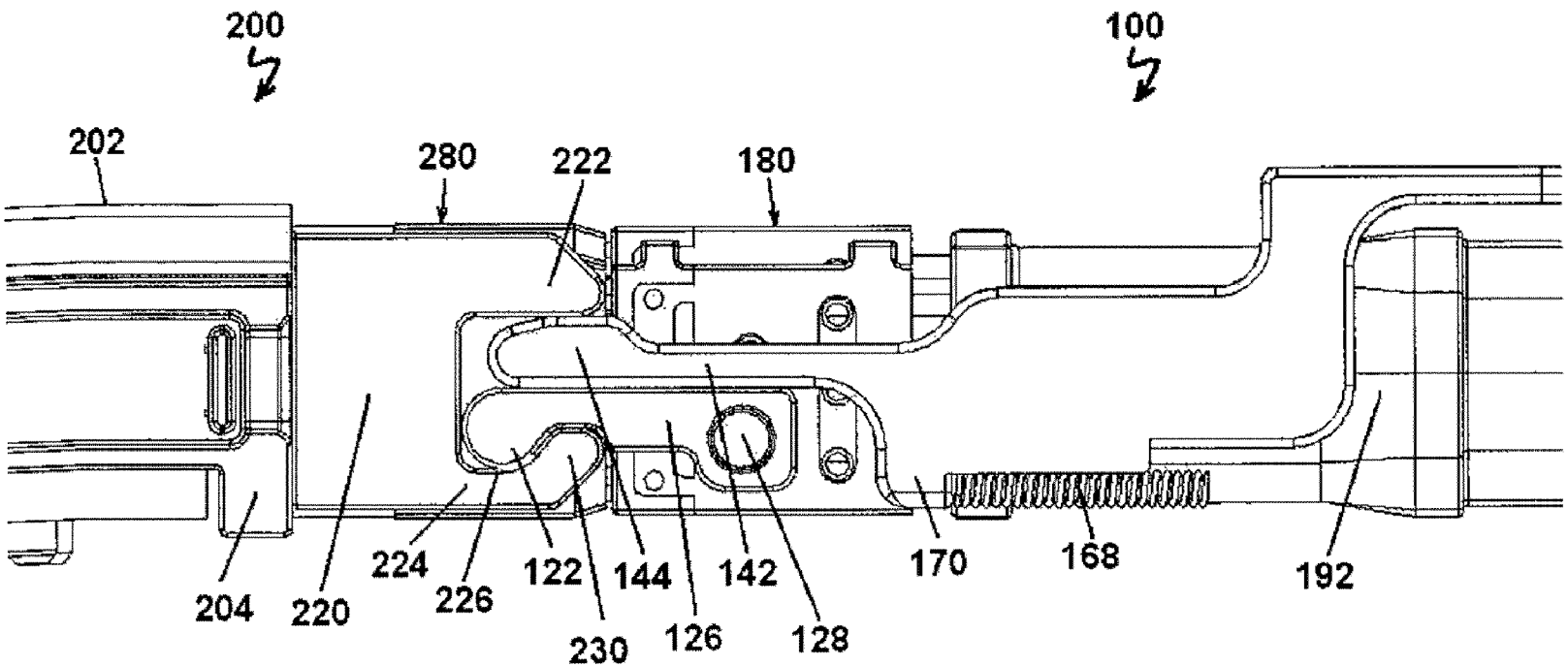
FIG. 12 is a partial side elevational view of the connector plug and the mating connector illustrated in FIG. 10, with a housing of the connector plug omitted for clarity.

Referring to FIGS. 10-12, the connector plug 100 and the mating connector 200 are shown, but the housing 102 and the spring clip 190 of the connector plug 100 are not depicted to illustrate internal components. To latchably couple the connector plug 100 to the mating connector 200, the operator grasps the housing 102 (shown in FIG. 1) of the connector plug 100. Because the housing 202 of the mating connector 200 does not extend over the front casing 284 or the front portion of the receiving lock members 220, the housing 102 of the connector plug 100 receives the front casing 284 and the front portions of the receiving lock members 220. The connector plug 100 and the mating connector 200 are aligned by keys 103 (shown in FIG. 2) in the housing 102. Turning to FIG. 10, when the housing 102 of the connector plug 100 is moved towards the mating connector 200, the pivoting lower latches 120 disposed in the housing 102 move towards the receiving lock members 220 of the mating connector 200. As the housing 102 moves further towards the mating connector 200, the upper and lower arms 222 and 224 enter the side channels 110 of the housing 102. The leading edges 132 of the lower latches 120 meet the leading edges 232 of the receiving lock members 220 as the connector plug 100 and the mating connector 200 are brought together. The leading edges 132 and 232 are rounded to provide smooth operation and prevent stubbing. The pivot supports 112 push the lower latches 120 forward as the housing 102 is moved forward.

Referring to FIG. 11, the engagement of the leading edges 132 with the leading edges 232 causes the lower latches 120 to pivot upward. The pivoting also prevents the upper latches 140 from moving towards the receiving lock members 220. The pivoting of the lower latches 120 causes the upper latches 140 to bend upward. The bending of the upper latches 140 causes the wedge portions 144 to hit the upper arms 222 as the housing 102 of the connector plug 100 moves towards the mating connector 200. Because the latch release mechanism 160 is prevented from moving forward by the receiving lock members 220, the latch release mechanism 160 compresses the springs 168 between the spring supporting portions 170 and the stop members 119 of the housing 102.

Referring to FIG. 12, as the housing 102 of the connector plug 100 moves further onto the mating connector 200, the heads 122 of the lower latches 120 continue to move past the leading edges 232 and enter the receiving lock members 220. The heads 122 slide along the top surfaces of the lips 230. As the lower latches 120 continue to move forward by force of the housing 102, the latching portions 130 of the lower latches 120 engage the inside faces 234 of the receiving lock members 220, and the heads 122 of the lower latches 120 are received in the bottoms 236 of the lower arms 224. After the lower latches 120 have pivoted downward and are fully received in the receiving lock members 220, the upper latches 140 slide downward and are no longer hitting the upper arms 222. The springs 168 then elastically decompress and force the upper latches 140 to move into the receiving lock members 220 by sliding over the top surfaces 136 of the lower latches 120.

As the upper latches 140 slide into the receiving lock members 220, the wedge portions 144 engage the inner upper surface of the upper arms 222 of the receiving lock members 220. The wedge portions 144 force the upper latches 140 downward slightly to ensure a tight fit of the lower latches 120 and upper latches 140 in the receiving lock members 220. The wedge portions 144 and the upper latches 140 are thus wedged between the lower arms 224 and the upper arms 222 of the receiving lock members 220. Thus, the upper arms 222 prevent the lower latches 120 from being able to pivot upward, thereby locking the upper latches 140 and lower latches 120 to the receiving lock members 220. The connector plug 100 and the mating connector 200 are thereby locked together, and the leads 184 (shown in FIG. 2) of wafers 180 in the connector plug 100 lockably engage the leads 290 (shown in FIG. 9) of the wafers 288 in the mating connector 200. Thus, the connector plug 100 and the mating connector 200 are coupled by using 1-2 fingers of one hand to grasp the housing 102 and push connector plug 100 to the mating connector 200.

The connector plug 100 and the mating connector 200 cannot be decoupled by pulling on the housing 102. Pulling the housing 102 pulls the lower latches 120, which are prevented from pivoting upward by the upper latches 140 which also prevents the lower latches 120 from withdrawing from the receiving lock member 220 because of the engagement of the lip 230 and the head 122. To decouple the connector plug 100 from the mating connector 200, the handle portion 166 of the latch release mechanism 160 is pulled away from the mating connector 200. A tool, such as a small screwdriver, can also be inserted into the hole 164 of the latch release mechanism 160 to pull the latch release mechanism 160 away from the mating connector 200. Pulling the handle portion 166 or the hole 164 causes the latch release mechanism 160 to withdraw the upper latches 140 from the receiving lock members 220 by sliding over the top surfaces 136 of the lower latches 120 while compressing the springs 168. As the latch release mechanism 160 slides past the lower latches 120, the wedge portions 144 are pulled out from the upper arms 222 of the receiving lock members 220, thereby allowing the lower latches 120 to pivot freely. Once the lower latches 120 are free to pivot, the latching portions 130 of the lower latches 120 slide away from the bottoms 236 and the inside faces 234 of the receiving lock members 220. After the latching portions 130 slides away from the leading edge 232 of the receiving lock members 220, the connector plug 100 and the mating connector 200 are decoupled. Thus, the connector plug 100 and the mating connector 200 are decoupled by using 1-2 fingers of a single hand.

Referring to FIG. 13, another embodiment of the handle portion 176 is shown. The latch release mechanism 160 extends over the cable braid 300. The handle portion 176 has a rounded grip 178 that projects up from the surface of the handle portion 176. Grip 178 facilitates the ability of user to hold the handle portion 176. The handle portion 176 does not interfere with adjacent handle portions 176 so that the user can more easily select a specific handle portion 176 to pull.

As apparent from the foregoing description, according to an exemplary embodiment of the invention, the latching system can be used with a connector assembly 10. The latching system provides a lockable latch that is operable by one hand or by a tool to couple or decouple the connector assembly 10. The latching system is also compact so that multiple connector assemblies 10 can be placed immediately next to each other.

In the non-limiting embodiment of FIG. 1, the lower latch 120, the upper latch 140, and a portion of the latch release mechanism 160 are disposed in a housing 102 of the connector plug 100, and the latch receiving member 220 is disposed towards the side of the mating connector 200. As apparent to one skilled in the art, in other embodiments, the lower latch 120, the upper latch 140, and the latch release mechanism 160 can be disposed on or in the mating connector 200, and the lock receiving member 220 can be disposed on or in the connector plug 100. Also, in the embodiment shown, there are two sets of lower latches 120, upper latches 140, and latch receiving members 220 disposed towards opposite sides of the connector plug 100 and the mating connector 200. The two upper latches 140 are coupled to the latch release mechanism 160. The number of lower latches 120, upper latches 140, latch receiving members 220, and latch release mechanisms 160 is not meant to be limiting. In other embodiments, there may be more or fewer than the number shown.

While a particular embodiment has been chosen to illustrate the invention, it will be understood by those skilled in the art that various changes and modifications can be made therein without departing from the scope of the invention as defined in the appended claims.

What is claimed is:

1. A latching system, comprising:
- a lower latch, the lower latch having,
  - a body with a top surface,
  - a head formed at one end of the body, the head including a leading edge and a latching portion, and
  - a pivot formed at an opposite end of the body;
- an upper latch slidably engaging the top surface of the lower latch, the upper latch having a wedge portion;
- a latch release mechanism coupled to the upper latch; and
- a receiving lock member having,
  - a lower arm with an upturned lip at a leading end formed to engage the leading edge of the lower latch,
  - an inside face continuously formed with the leading end and a bottom formed on an inner part of the upturned lip, and,
  - an upper arm that engages the wedge portion of the upper latch.

2. A latching system according to claim 1, wherein the body has opposite side surfaces and the pivot is formed on one of the opposite side surfaces.

3. A latching system according to claim 1, wherein, the lower latch pivots when the lower latch engages the leading ends of the lower arm.

4. A latching system according to claim 1, wherein the upper latch prevents the pivoting of the lower latch when the upper latch engages the upper arm.

5. A latching system according to claim 1, further comprising a handle portion coupled to the latch release mechanism.

6. A latching system according to claim 1, wherein the lower latch and the upper latch lock into the receiving lock member.

7. A latching system according to claim 1, wherein the latch release mechanism includes a hole.

8. A latching system according to claim 1, wherein the latch release mechanism further comprises a spring supporting portion.

9. A latching system according to claim 8, further comprising:
- a housing disposed substantially around the lower latch, the upper latch, and a portion of the latch release mechanism, the housing having,
  - a pivot support disposed on an inner surface of the housing to receive the pivot of the lower latch, and
  - a stop member disposed on the inner surface of the housing; and
- a spring disposed between the spring supporting portion and the stop member.

10. A latching system according to claim 9, wherein the spring elastically biases the latch release member towards the receiving lock member and pulling the latch release mechanism disengages the upper latch from the upper arm to allow the lower latch to pivot.

11. A latching system according to claim 9, wherein the housing further comprises:
- a side wall; and a divider panel set apart from the side wall to form a side channel therebetween, wherein the pivot support is disposed within the side channel to receive the pivot of the lower latch, the stop member is disposed at a distal end of the side channel, and the spring is disposed between the spring supporting portion and the stop member.

12. A latching system according to claim 9, wherein the housing is formed from a plurality of parts coupled to each other by a spring clip.

13. A latching system according to claim 9, further comprising a wafer disposed in the housing.

14. A latching system, comprising:

a plurality of lower latches, each of the plurality of lower latches having, a body with a top surface, a head formed at one end of the body, the head including a leading edge and a latching portion, and a pivot formed at an opposite end of the body;

a plurality of upper latches, each of the plurality of upper latches slidably engaging the respective top surface of one of the plurality of lower latches, each of the plurality of upper latches having a wedge portion;

a latch release mechanism coupled to the plurality of upper latches; and a plurality of receiving lock members, each of the plurality of receiving lock members having, a lower arm with an upturned lip at a leading end formed to engage the leading edge of one of the plurality of lower latches, an inside face continuously formed with the leading end and a bottom formed on an inner part of the upturned lip, and an upper arm that engages the wedge portion of one of the plurality of upper latches.

15. A latching system according to claim 14, wherein the body has opposite side surfaces and the pivot is formed on one of the opposite side surfaces.

16. A latching system according to claim 14, wherein at least one of the plurality of lower latches pivot when the plurality of lower latches engages at least one of the corresponding leading ends of the lower arms.

17. A latching system according to claim 14, wherein the plurality of upper latches prevent the pivoting of the plurality of lower latches when at least one of the plurality of upper latches engages the upper arm.

18. A latching system according to claim 14, further comprising a handle portion coupled to the latch release mechanism.

19. A latching system according to claim 14, wherein the plurality of lower latches and the plurality of upper latches lock into the plurality of receiving lock members.

20. A latching system according to claim 14, wherein the latch release mechanism includes a hole.

21. A latching system according to claim 14, wherein the latch release mechanism further comprises a spring supporting portion.

22. A latching system according to claim 21, further comprising:

a housing disposed substantially around the plurality of lower latches, the plurality of upper latches, and a portion of the latch release mechanism, the housing having, a plurality of pivot supports disposed on an inner surface of the housing to receive the pivots of the plurality of lower latches, and a stop member disposed on the inner surface of the housing; and a spring disposed between the spring supporting portion and the stop member.

23. A latching system according to claim 22, wherein the spring elastically biases the latch release member towards the plurality of receiving lock members and pulling the latch release mechanism disengages the plurality of upper latches from the respective upper arm to allow the plurality of lower latches to pivot.

24. A latching system according to claim 22, wherein the housing further comprises:

a plurality of side walls; and a plurality of divider panels, each of the plurality of divider panels set apart from one of the plurality of side walls to form a side channel therebetween, wherein each of the plurality of pivot supports are disposed within the one of the side channels to receive the pivot of one of the plurality of lower latches, the stop member is disposed at a distal end of one of the plurality of side channels, and the spring is disposed between the spring supporting portion and the stop member.

25. A latching system according to claim 22, wherein the housing is formed from a plurality of parts coupled to each other by a spring clip.

26. A latching system according to claim 22, further comprising a wafer disposed in the housing.

* * * * *